US009140497B2

(12) United States Patent
Al-Shahrani

(10) Patent No.: US 9,140,497 B2
(45) Date of Patent: Sep. 22, 2015

(54) CLOTHES DRYING RACK

(71) Applicant: UMM AL-QURA UNIVERSITY, Makkah (SA)

(72) Inventor: Sarah O. Al-Shahrani, Khamis Mushayt (SA)

(73) Assignee: UMM AL-QURA UNIVERSITY, Makkah (SA)

( * ) Notice: Subject to any disclaimer, the term of this patent is extended or adjusted under 35 U.S.C. 154(b) by 118 days.

(21) Appl. No.: 14/182,234

(22) Filed: Feb. 17, 2014

(65) Prior Publication Data

US 2015/0233638 A1 Aug. 20, 2015

(51) Int. Cl.
*F26B 19/00* (2006.01)
*F26B 25/18* (2006.01)

(52) U.S. Cl.
CPC ..... *F26B 25/18* (2013.01)

(58) Field of Classification Search
CPC ..... F26B 3/00; F26B 5/00; F26B 11/00; F26B 19/00; H05B 1/00; D06F 57/08; D06F 57/125
USPC ..... 34/95, 104, 105; 219/217, 385; 211/26, 211/85, 85.3, 104, 113; 223/67, 88; D32/58
See application file for complete search history.

(56) References Cited

U.S. PATENT DOCUMENTS 1,866,987 A 7/1932 Principessa et al.
3,696,523 A 10/1972 Beeley et al.
3,899,108 A 8/1975 Frauendorf
5,469,635 A 11/1995 Lamontagne et al.
5,592,750 A * 1/1997 Eichten ..... 34/104
D394,926 S * 6/1998 Lindsay ..... D32/58
5,862,606 A * 1/1999 Jannach ..... 34/106
5,987,773 A * 11/1999 Lipscy ..... 34/106
6,035,545 A * 3/2000 Jones ..... 34/202
6,796,053 B2 9/2004 Lurie
6,880,711 B2 * 4/2005 Collier ..... 211/85.7
7,430,816 B1 * 10/2008 Lozenski ..... 34/104
D615,715 S 5/2010 Zielinski
D616,621 S 5/2010 Prokop
7,723,646 B2 * 5/2010 Lam ..... 219/217
7,770,305 B1 * 8/2010 Krauss ..... 34/60

(Continued)

FOREIGN PATENT DOCUMENTS

CN 202000165 10/2011
EP 2481846 A1 * 8/2012

(Continued)

*Primary Examiner* — Stephen M Gravini
(74) *Attorney, Agent, or Firm* — Richard C. Litman

(57) ABSTRACT

The clothes drying rack has a generally horizontal rectangular frame with a series of intermediate lateral members and support legs. The various elements are formed of hollow pipe or tube, with most being perforated. Additional perforated tubular members depend from the lateral members. A portable fluid supply unit is remotely situated from the frame and connected to a non-perforated leg of the frame by a suitable duct, with the fluid supply unit having a fan therein to provide air to the tubular frame to flow from the perforated tubes, thereby circulating through clothing suspended on the frame. The fluid supply unit may also include a water dispenser and a heating element therefor, to produce steam to reduce wrinkling of the clothing. A fragrance tank and dispenser may also be included with the fluid supply unit, to dispense a pleasant fragrance through the frame and to the clothing suspended thereon.

20 Claims, 2 Drawing Sheets

(56) References Cited

U.S. PATENT DOCUMENTS

| | | | | |
|---|---|---|---|---|
| 8,726,534 | B2 * | 5/2014 | Chappell et al. | 34/202 |
| 8,739,432 | B2 * | 6/2014 | Rydinsky | 34/289 |
| 8,844,154 | B2 * | 9/2014 | McLoughlin et al. | 34/104 |
| 8,966,781 | B1 * | 3/2015 | McKernan | 34/105 |
| 9,015,955 | B2 * | 4/2015 | Vezina et al. | 34/60 |
| 2006/0054576 | A1 * | 3/2006 | Durham | 211/85.7 |
| 2007/0205173 | A1 | 9/2007 | Garman et al. | |
| 2012/0137534 | A1 | 6/2012 | Barnard | |

FOREIGN PATENT DOCUMENTS

| | | | | |
|---|---|---|---|---|
| FR | 2694174 | A1 * | 2/1994 | A47F 5/01 |
| GB | 433301 | * | 8/1935 | |
| WO | WO 2012129751 | A1 * | 10/2012 | |
| WO | WO 2012168505 | A1 * | 12/2012 | |

* cited by examiner

CLOTHES DRYING RACK

BACKGROUND OF THE INVENTION

1. Field of the Invention

The present invention relates generally to laundry washing and drying, and particularly to a clothes drying rack having a fan, water supply, fragrance supply, and heating element connected thereto for the selective dispensing of steam and fragrance to clothing suspended on the rack.

2. Description of the Related Art

Racks, stands, and similar devices for supporting clothing and the like for indoor drying have been known for a considerable period of time. Such drying racks permit clothing to dry indoors if the weather is not suitable for outdoor drying. While the development of the automatic clothing dryer has greatly reduced the use of such passive drying racks, they still find favor in many areas and can provide various advantages in terms of reduced energy usage and expense.

The conventional clothes drying rack is a passive structure, serving only to suspend clothing and the like to expose as much surface area as practicable in order to maximize air circulation around the clothing for evaporation of water from the clothing. However, clothes drying using such conventional clothes drying rack typically does nothing more than to remove the moisture from the clothing. Clothing suspended from such a rack can be susceptible to wrinkling and absorption of various odors from the indoor environment. While the clothing may be clean after washing and drying upon a conventional rack, a perception may be that the clothing is not clean due to various scents or odors absorbed and any wrinkles formed in the clothing during the drying process.

Accordingly, various modifications of drying racks for clothing have been developed in the past. An example of such is found in Chinese Patent Publication No. 202000165 published on Oct. 5, 2010 to Yu Quanfeng. This document describes a clothes drying rack including a series of interconnected hollow perforated pipes and hangers. Air is blown through the pipes and their hangers to circulate through clothing suspended on the hangers.

Thus, a clothes drying rack addressing the aforementioned problems is desired.

SUMMARY OF THE INVENTION

Embodiments of a clothes drying rack includes a frame, such as a horizontal rectangular frame, formed of hollow structures, such as tubes or pipes. A series of parallel lateral members extend between the longitudinal members, with the longitudinal members being closed, i.e., non-perforated or imperforate, and other horizontal members being perforated. The rack is supported by a plurality of support legs, some of which can be perforated, with a single closed, non-perforated or imperforate leg supporting one corner or portion of the clothes drying rack.

A remotely located fluid supply unit is connected to the non-perforated leg by a suitable duct. The fluid supply unit includes a motor-driven fan, drawing ambient air external to the unit through the unit and the duct to exit the pores or perforations of the various pipes and tubes of the rack to enhance air circulation through clothing suspended thereon. The fluid supply unit may also include a tank of water and a heating element to produce steam, which is discharged into the duct to steam clothing suspended on the rack, thereby reducing or eliminating wrinkling of the clothing. A fragrance tank may also be provided with the unit, with the fragrance tank selectively delivering fragrances through the duct and pipes or tubes of the rack to the clothing suspended thereon.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Embodiments of a clothes drying rack are capable of providing ambient air, heated air, moisture at ambient temperature, heated moisture or steam, and/or a fragrance to clothing, laundry, or other articles suspended thereon. The clothes drying rack utilizes relatively little power in comparison to a conventional laundry dryer, thus conserving energy and resources. The steam provided by the clothes drying rack can assist in removing unwanted wrinkles from clothing, thereby also conserving energy that would otherwise be required to remove the wrinkles, such as energy used by ironing the clothing.

Figure 1:
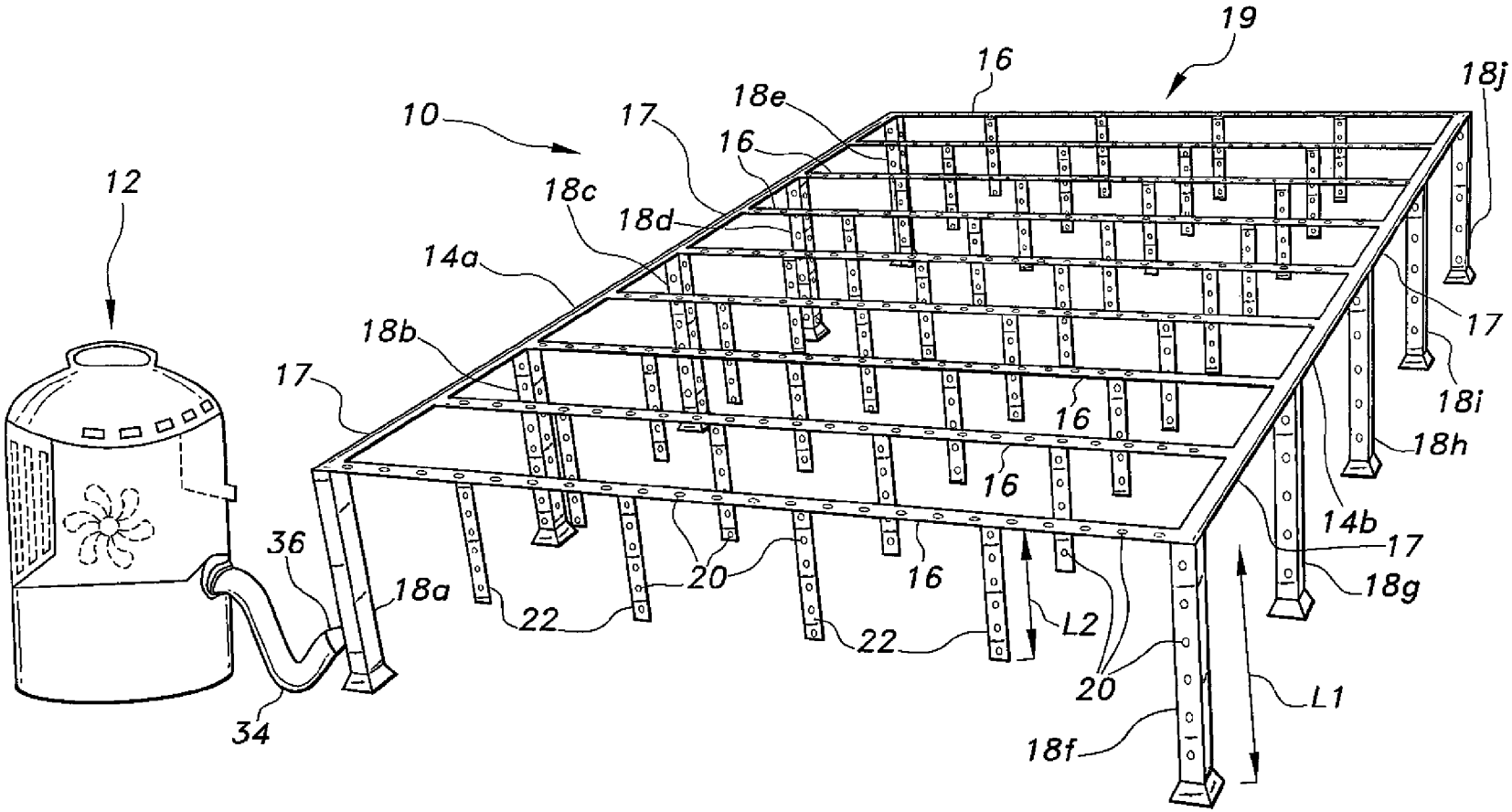
FIG. 1 is a perspective view of a clothes drying rack according to the present invention, with the air, water, and fragrance dispensing unit shown connected thereto.

FIG. 1 of the drawings provides a perspective view of the clothes drying rack 10, with its fluid supply unit 12 connected thereto. The clothes drying rack 10 generally includes opposed, spaced apart, parallel first and second elongate longitudinal frame members 14*a* and 14*b* having a series of spaced apart, parallel elongate lateral frame members 16 extending, such as orthogonally, therebetween and in communication with the first and second longitudinal frame members 14*a* and 14*b* to form a frame 19, such as a rectangular structure, for the clothes drying rack 10. The clothes drying rack 10 is supported by a series of support legs 18*a* through 18*j* depending from the frame 19, such as the two longitudinal frame members 14*a* and 14*b*, with the support legs 18*a* through 18*j* supporting the clothes drying rack 10 at a predetermined desired level above the underlying surface on which the support legs 18*a* through 18*j* are placed. The support legs 18*a* through 18*j* can be of an equal or substantially equal predetermined length L1, for example.

The above-described components 14*a* through 18*j* are formed of a number of hollow structures, such as hollow pipes, hollow tubes or hollow tubular members, for fluid communication through the frame 19 and through components of the clothes drying rack 10, and the interiors of the hollow structures can communicate with one another to allow fluid flow therethrough, such fluid including water, steam, air, a fragrance, or a mixture of two or more fluids thereof, etc. The hollow structures of the clothes drying rack 10 can be of various suitable shapes, such as a cylindrical shape, a square shape or a rectangular shape, for example. Also, the components 14*a* through 18*j* of the clothes drying rack 10 are formed of a suitable material, such as a plastic material or a rust-resistant material, or a material that is coated with a rust-resistant paint, for example. The two longitudinal frame members 14*a* and 14*b* are otherwise closed, i.e., imperforate, and include hollow walls 17, such as can be continuously unbroken hollow walls or can include joined hollow walls, that form a hollow structure respectively extending between, for example, each of the lateral frame members 16 and support legs 18*a* through 18*j*. However, each of the lateral frame members 16 and the support legs 18*b* through 18*j* can include numerous perforations 20 to allow a fluid or a plurality of fluids (e.g., air, water, steam, fragrance, etc.) to flow therefrom out of the clothes drying rack 10 for the treatment of clothing, laundry or other items suspended upon the clothes drying rack 10. It will be noted that at least one of the support legs, such as the first support leg 18*a* typically is not perforated, as the first support leg 18*a* is a hollow structure that is imperforate in order to receive and distribute fluids from the fluid supply unit 12 to the other components of the clothes drying rack 10, as described further below.

Each of the lateral frame members 16 has a series of extensions 22 depending therefrom. The extensions 22 are also formed as hollow structures, such as hollow pipes, hollow tubes or hollow tubular members, with their interiors communicating with the interiors of the corresponding lateral frame members 16 from which they depend. Each of the depending extensions 22 also includes a plurality of perforations 20 therein to distribute a fluid, such as air, water, steam, fragrance, etc., through any clothing, items and/or laundry suspended on the clothes drying rack 10. Each of the extensions 22 has a predetermined length L2 that can be typically somewhat shorter than the lengths L1 of the support legs 18*a* through 18*j*, with the lower ends of the extensions 22 thus being suspended and extending from the clothes drying rack 10 somewhat above the underlying surface on which the support legs 18*a* through 18*j* of the clothes drying rack 10 are placed. Thus, the only contact of the clothes drying rack 10 with the underlying surface is through the lower ends or footpads of the support legs 18*a* through 18*j*.

Figure 2:
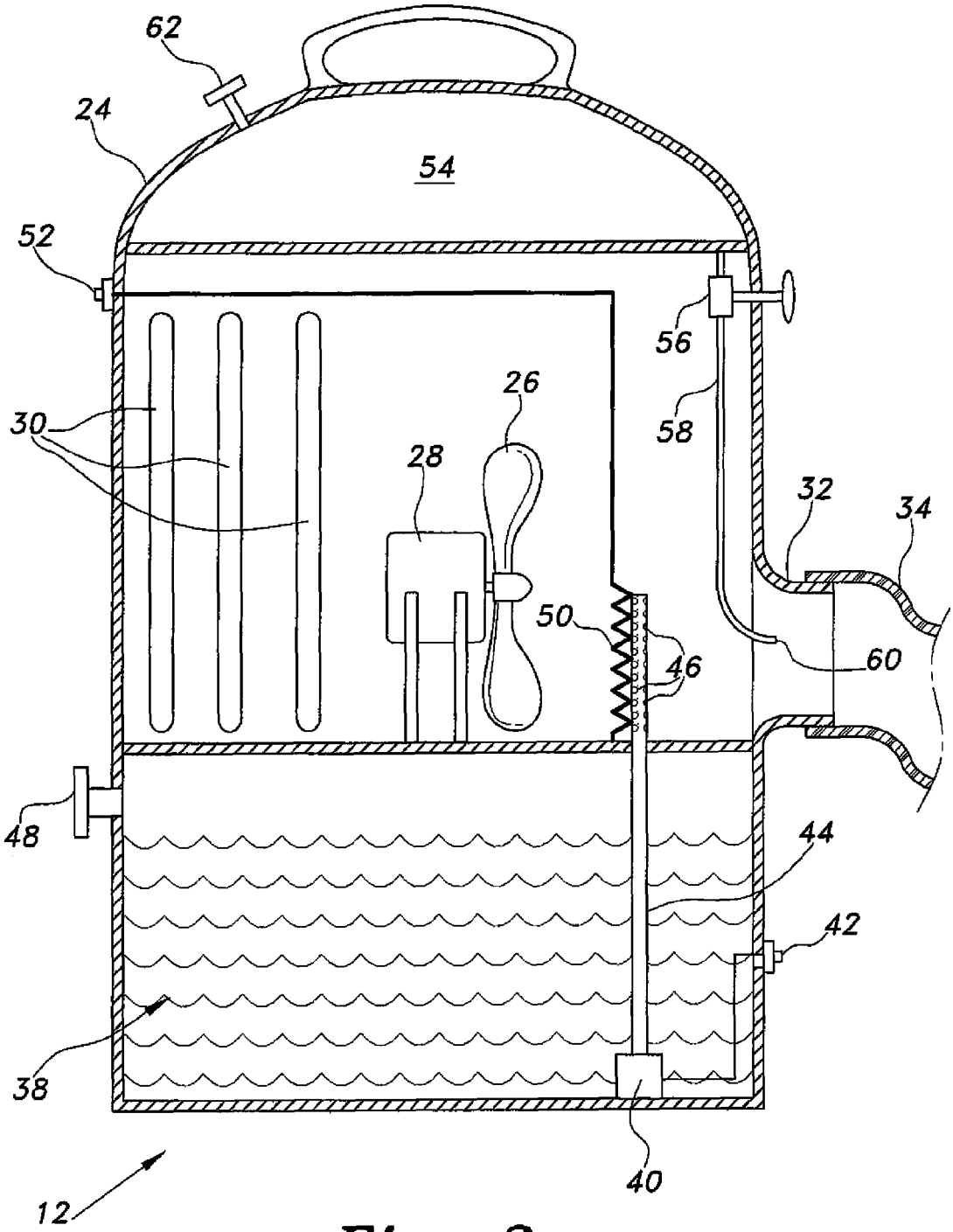
FIG. 2 is an elevation view in section of the air, water, and fragrance dispensing unit of the clothes drying rack according to the present invention.

FIG. 2 of the drawings provides a detailed elevation view in section of the fluid supply unit 12. The fluid supply unit 12 includes a housing 24 including a fan 26 driven by a motor 28 therein. Electrical power and control for the fan motor 28 is conventional, and not shown in the drawings. The fan 26 draws ambient air through a series of inlet vents 30 in the side of the housing 24, and expels the air through an outlet 32 to a duct 34, the duct 34 being a plastic hose, for example. The duct 34 is in turn connected to the fluid inlet 36 of the first leg or inlet leg 18*a* (FIG. 1), for example. The first or inlet leg 18*a* is closed, hollow and imperforate as noted further above, except for the fluid inlet 36. The upper end of the inlet leg 18*a* communicates internally directly with the frame 19, such as with the first longitudinal frame member 14*a* and the corresponding lateral frame member 16, to supply air or other fluid to the clothes drying rack 10. Thus, any air or other fluid delivered to the first or inlet leg 18*a* is substantially precluded from escape through the outer wall of the inlet leg 18*a* and flows to the adjoining first longitudinal frame member 14*a* and the corresponding lateral frame member 16 to flow through the various hollow structures of the clothes drying rack 10, such as pipes and tubes, to be expelled through the perforations 20 therein.

In the fluid supply unit 12, a water tank 38 is provided within the housing 24, e.g., in its lower portion. A pump 40 is installed in the bottom of the water tank 38, with the pump being controlled by an electrical switch 42. The pump 40 delivers water from the tank 38, up through a delivery tube 44 that includes a series of perforations or nozzles, spray orifices, etc. 46 in its upper end. The fan 26 blows air past the upper end of the delivery tube 44 and its spray orifices 46, thereby introducing a fine mist of water into the airflow as it enters the duct 34 to the clothes drying rack 10. A filler orifice and cap 48 for the water tank 38 is provided in one side of the housing 12.

At times, it may be desirable to provide heated water mist or steam through the clothes drying rack 10 to steam or mist the clothing suspended thereon to assist in removing wrinkles from the clothing or laundry on the clothes drying rack 10. Accordingly, a heating element 50 is provided with the perforated outlet end or nozzle of the water delivery tube 44 that includes the perforations, nozzles or orifices 46. The heating element 50 is selectively controlled by a heater control switch 52 disposed in some convenient location on the housing 24.

The clothes drying rack 10 and its fluid supply unit 12 may also deliver a fragrance to the clothing, items or laundry suspended on the clothes drying rack 10. The fluid supply unit 12 includes a fragrance supply tank 54 therein, e.g., in the upper portion of the housing 24. A control valve 56 is installed in-line in a fragrance dispensing or delivery tube 58, with a handle extending from the housing 24 for convenient control. The outlet end 60 of the fragrance dispensing or delivery tube 58 is desirably disposed within the outlet 32 of the housing 24, such as between the water nozzle or orifice end of the water deliver tube 44 and the duct 34. A fragrance tank filler orifice and cap 62 are provided for replenishing the fragrance as needed. Thus, the clothes drying rack 10 and its fluid supply unit 12 may dispense ambient air among clothing, items and/or laundry suspended on the clothes drying rack 10, or may heat that air to enhance drying. Alternatively, moisture may be added to the airflow as described above, with the heating element providing for the heating of the moisture to produce steam, if sufficient heat is provided. Finally, a fragrance may be added to the airflow to the clothes drying rack 10 to impart a pleasing scent to the clothing and/or laundry suspended on the rack, according to the desires of the user.

It is to be understood that the present invention is not limited to the embodiments described above, but encompasses any and all embodiments within the scope of the following claims.

I claim:

1. A clothes drying rack, comprising:

first and second hollow elongate longitudinal frame members extending in parallel relation to each other, the first and second hollow elongate longitudinal frame members having imperforate wall structures;

a plurality of hollow elongate lateral frame members disposed in parallel relation to each other and extending between and in fluid communication with the first and second hollow elongate longitudinal frame members to communicate a fluid through the clothes drying rack, the imperforate wall structures of the first and second longitudinal frame members extending between the lateral frame members, the lateral frame members having a plurality of perforations to flow the fluid out of the clothes drying rack, and the first and second longitudinal frame members and the lateral frame members collectively defining a frame of the clothes drying rack; and a plurality of support legs respectively depending from the first and second longitudinal frame members, at least one of the plurality of support legs being in fluid communication with at least one of the first and second longitudinal frame members and having a hollow imperforate structure to communicate the fluid though the clothes drying rack.

2. The clothes drying rack according to claim 1, further comprising;

a plurality of extensions depending from and in fluid communication with the lateral frame members, the extensions being hollow perforated structures to flow the fluid out of the clothes drying rack.

3. The clothes drying rack according to claim 2, wherein at least one of the plurality of support legs, other than the at least one hollow imperforate support leg, has a hollow structure and has a plurality of perforations to flow the fluid out of the clothes drying rack, the at least one perforated support leg being in fluid communication with a corresponding at least one of the first and second longitudinal frame members.

4. The clothes drying rack according to claim 1, wherein at least one of the plurality of support legs, other than the at least one hollow imperforate support leg, has a hollow structure and has a plurality of perforations to flow the fluid out of the clothes drying rack, the at least one perforated support leg being in fluid communication with a corresponding at least one of the first and second longitudinal frame members.

5. The clothes drying rack according to claim 1, further comprising:

a fluid supply unit to supply the fluid to the clothes drying rack; and a duct connecting the fluid supply unit to a fluid inlet of the clothes drying rack to receive the fluid to flow through the clothes drying rack, wherein the at least one hollow imperforate support leg includes the fluid inlet.

6. The clothes drying rack according to claim 5, wherein the fluid supply unit comprises:

a housing;

a motorized fan disposed within the housing;

a water tank disposed within the housing; and a fragrance tank disposed within the housing.

7. The clothes drying rack according to claim 6, further comprising:

a water dispensing nozzle disposed within the housing, the water dispensing nozzle communicating with the water tank; and a heating element disposed with the water dispensing nozzle.

8. The clothes drying rack according to claim 6, further comprising:

a fragrance dispensing tube disposed within the housing, the fragrance dispensing tube communicating with the fragrance tank.

9. A clothes drying rack, comprising:

first and second hollow elongate longitudinal frame members extending in parallel relation to each other, the first and second hollow elongate longitudinal frame members having imperforate wall structures;

a plurality of hollow elongate lateral frame members disposed in parallel relation to each other and extending between and in fluid communication with the first and second hollow elongate longitudinal frame members to communicate a fluid through the clothes drying rack, the imperforate wall structures of the first and second longitudinal frame members extending between the lateral frame members, and the first and second longitudinal frame members and the lateral frame members collectively defining a frame of the clothes drying rack;

a plurality of support legs depending from the frame of the clothes drying rack to support the clothes drying rack; and a plurality of extensions depending from and in fluid communication with the lateral frame members, the extensions being hollow perforated structures to flow the fluid out of the clothes drying rack.

10. The clothes drying rack according to claim 9, wherein the lateral frame members have a plurality of perforations to flow the fluid out of the clothes drying rack, and one or more of the plurality of support legs have a hollow structure and have a plurality of perforations to flow the fluid out of the clothes drying rack, the one or more perforated support legs being in fluid communication with the frame of the clothes drying rack.

11. The clothes drying rack according to claim 9, further comprising:

a fluid supply unit to supply the fluid to the clothes drying rack; and a duct connecting the fluid supply unit to a fluid inlet of the clothes drying rack to receive the fluid to flow through the clothes drying rack, wherein at least one of the plurality of support legs includes the fluid inlet and is in fluid communication with the frame of the clothes drying rack and has a hollow imperforate structure to communicate the fluid though the clothes drying rack.

12. The clothes drying rack according to claim 11, wherein the fluid supply unit comprises:

a housing;

a motorized fan disposed within the housing;

a water tank disposed within the housing; and a fragrance tank disposed within the housing.

13. The clothes drying rack according to claim 12, further comprising:

a water dispensing nozzle disposed within the housing, the water dispensing nozzle communicating with the water tank; and a heating element disposed with the water dispensing nozzle.

14. The clothes drying rack according to claim 12, further comprising:

a fragrance dispensing tube disposed within the housing, the fragrance dispensing tube communicating with the fragrance tank.

15. A clothes drying rack, comprising:

first and second hollow elongate longitudinal frame members extending in parallel relation to each other, the first and second hollow elongate longitudinal frame members having imperforate wall structures;

a plurality of hollow elongate lateral frame members disposed in parallel relation to each other and extending between and in fluid communication with the first and second hollow elongate longitudinal frame members to communicate a fluid through the clothes drying rack, the imperforate wall structures of the first and second longitudinal frame members extending between the lateral frame members, the lateral frame members having a plurality of perforations to flow the fluid out of the clothes drying rack, and the first and second longitudinal frame members and the lateral frame members collectively defining a frame of the clothes drying rack;

a plurality of support legs respectively depending from the frame of the clothes drying rack, a support leg of the plurality of support legs comprising an inlet leg having a hollow imperforate structure to communicate the fluid though the clothes drying rack and having a fluid inlet to receive the fluid to flow through the clothes drying rack;

a fluid supply unit remotely disposed from the frame of the clothes drying rack; and a duct connecting the fluid supply unit to the fluid inlet of the inlet leg to supply the fluid to the clothes drying rack.

16. The clothes drying rack according to claim 15, wherein one or more of the plurality of support legs have a hollow structure and have a plurality of perforations to flow the fluid out of the clothes drying rack, the one or more perforated support legs being in fluid communication with the frame of the clothes drying rack.

17. The clothes drying rack according to claim 15, further comprising:

a plurality of extensions depending from and in fluid communication with the lateral frame members, the extensions being hollow perforated structures to flow the fluid out of the clothes drying rack.

18. The clothes drying rack according to claim 15, wherein the fluid supply unit comprises:

a housing;

a motorized fan disposed within the housing;

a water tank disposed within the housing; and a fragrance tank disposed within the housing.

19. The clothes drying rack according to claim 18, further comprising:

a water dispensing nozzle disposed within the housing, the water dispensing nozzle communicating with the water tank; and a heating element disposed with the water dispensing nozzle.

20. The clothes drying rack according to claim 18, further comprising:

a fragrance dispensing tube disposed within the housing, the fragrance dispensing tube communicating with the fragrance tank.

* * * * *